US011353036B2

(12) United States Patent
Scarbolo

(10) Patent No.: US 11,353,036 B2
(45) Date of Patent: Jun. 7, 2022

(54) BALANCING SYSTEM AND METHOD FOR TURBOMACHINE

(71) Applicant: Nuovo Pignone Tecnologie Srl, Florence (IT)

(72) Inventor: Luca Scarbolo, Florence (IT)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 0 days.

(21) Appl. No.: 16/202,027

(22) Filed: Nov. 27, 2018

(65) Prior Publication Data

US 2019/0170152 A1 Jun. 6, 2019

(30) Foreign Application Priority Data

Dec. 1, 2017 (IT) ..... 102017000138975

(51) Int. Cl.

| | |
|---|---|
| ***F04D 29/051*** | (2006.01) |
| ***F01D 3/04*** | (2006.01) |
| ***F04D 29/12*** | (2006.01) |
| ***F04D 29/041*** | (2006.01) |

(52) U.S. Cl.

CPC ..... *F04D 29/0516* (2013.01); *F01D 3/04* (2013.01); *F04D 29/0416* (2013.01); *F04D 29/122* (2013.01); *F05D 2220/32* (2013.01); *F05D 2240/10* (2013.01); *F05D 2240/52* (2013.01); *F05D 2240/55* (2013.01); *F05D 2260/15* (2013.01)

(58) Field of Classification Search

CPC . F01D 3/00; F01D 3/04; F04D 29/051; F04D 29/0516; F04D 29/041; F04D 29/0416

See application file for complete search history.

(56) References Cited

U.S. PATENT DOCUMENTS 5,203,673 A * 4/1993 Evans ..... F01D 11/22 415/10

2011/0286835 A1* 11/2011 Van Der Span ..... F01D 3/04 415/133

FOREIGN PATENT DOCUMENTS

| | | |
|---|---|---|
| CA | 2075604 A1 | 2/1994 |
| WO | 2010089198 A2 | 8/2010 |
| WO | 2011078680 A1 | 6/2011 |

OTHER PUBLICATIONS

IT Search Report and Written Opinion issued in connection with corresponding Application No. IT 102017000138975 dated Apr. 26, 2018.

* cited by examiner

*Primary Examiner* — Richard A Edgar

(74) *Attorney, Agent, or Firm* — Baker Hughes Patent Org.

(57) ABSTRACT

The balancing system has a balancing body to be mounted on a rotor of a turbomachine and a sealing ring to be mounted on a stator of the turbomachine; the sealing ring is arranged around the balancing body so that the balancing body can rotate about a rotation axis, thus there is a clearance between the body and the ring; furthermore, there is an arrangement for changing an axial position of the sealing ring during operation of the turbomachine so that the clearance can be adjusted. The possibility of adjusting clearance during operation of the turbomachine, such balancing system provides a good balancing action with a small leakage and a small risk of mechanical interference at any time during operation of the turbomachine.

10 Claims, 4 Drawing Sheets

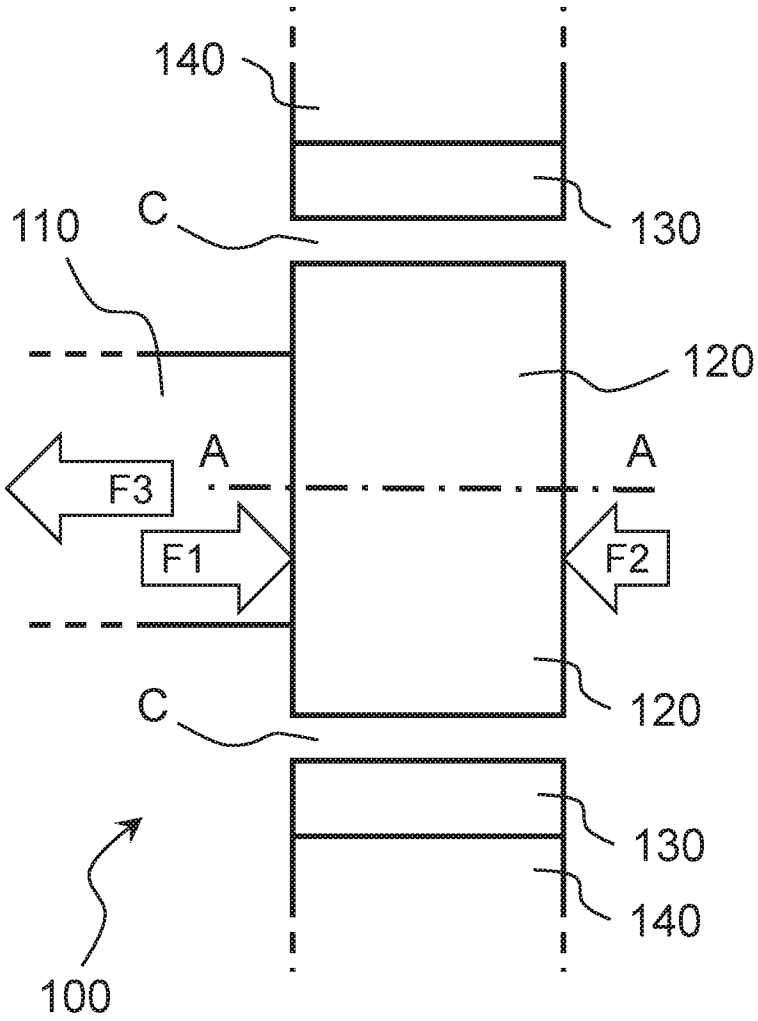
Fig. 1 - Prior Art
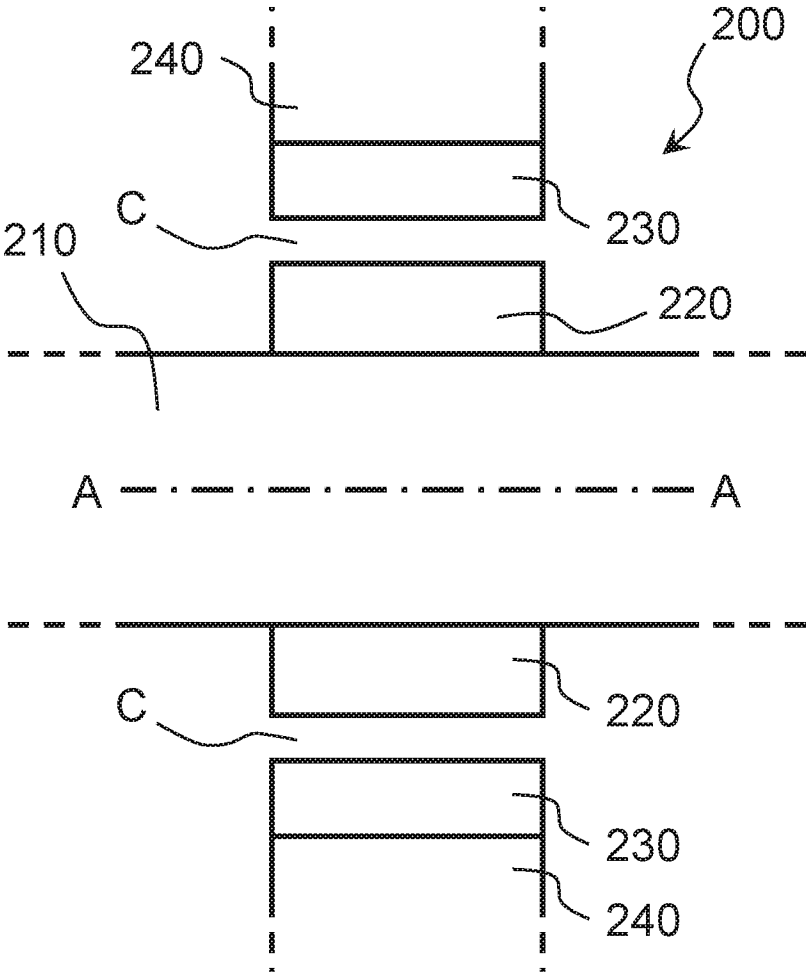
Fig. 2 - Prior Art

BALANCING SYSTEM AND METHOD FOR TURBOMACHINE

TECHNICAL FIELD

Embodiments of the subject matter disclosed herein correspond to balancing systems and balancing methods for turbomachines as well as turbomachines using them.

BACKGROUND OF THE INVENTION

Turbomachines such as compressors, pumps, turbines and expanders, create axial forces when rotating during their operation.

Thrust bearings are used in turbomachines in order to counteract such axial forces.

Balancing systems may be used in order to reduce the thrust to be borne by the bearings.

A typical type of balancing system is the so-called "balance drum". It is a cylinder fixed to an end of a shaft of a rotor of e.g. a compressor such as for example the one schematically shown in FIG. 1 wherein the balancing system of the compressor is labeled 100, the shaft is labeled 110, the cylinder is labeled 120 and there is a sealing ring 130 fixed to an internal wall 140 of a case of the compressor and arranged around cylinder 120 so that cylinder 120 can rotate about a rotation axis A. During operation of the compressor, an internal side of cylinder 120 (on the left in FIG. 1) is exposed to e.g. a discharge pressure of the compressor and a first axial force F1 is exerted on cylinder 120; an external side of cylinder 120 (on the right in FIG. 1) is exposed to e.g. a suction pressure of the compressor and a second axial force F2 is exerted on cylinder 120. During operation of the compressor, the shaft is subject to an axial force due to a working fluid acting on rotating components, for example impellers (not shown in FIG. 1), of the rotor of the compressor; such shaft axial force should be borne entirely by a thrust bearing (not shown in FIG. 1) if no balancing system would be used. In FIG. 1, such shaft axial force F3 is counteracted by the net axial force deriving from the above-mentioned first axial force F1 and the above-mentioned second axial force F2.

FIG. 2 shows a system 200 similar to system 100 of FIG. 1 wherein a cylinder 220 is fixed to a shaft 210 of a rotor of e.g. a compressor at an intermediate position of the shaft; there is also a sealing ring 230 fixed to an internal wall 240 of a case of the compressor and arranged around cylinder 220 so that cylinder 120 can rotate about a rotation axis A. System 200 is used for example to separate two stages of the compressor and to counteract an axial force acting on shaft 210 and due to a working fluid acting on rotating components (not shown in FIG. 2) of the rotor of the compressor.

As shown in FIG. 1 and FIG. 2, there is a clearance C between cylinder 120/220 and sealing ring 130/230.

Typically, clearance C is kept small to avoid excessive leakage of working fluid through the clearance from one side of the cylinder (at e.g. discharge pressure) to the other side of the cylinder (at e.g. suction pressure) during operation of the turbomachine. But clearance C is not made too small in order to avoid mechanical interferences between cylinder and sealing ring when assembling the turbomachine and during operation of the turbomachine.

It is to be noted that, during operation of a turbomachine, a cylinder of a "balance drum", such as for example the ones shown in FIG. 1 and FIG. 2, may change its position and/or its shape and/or its size due to pressures of fluids inside the turbomachine, heating of components of the turbomachine, rotation of a rotor of the turbomachine. The possibility of such changes leads to using balancing systems with a rather large clearance (see FIG. 1 and FIG. 2) in turbomachines.

It would be desirable to have a balancing system for a turbomachine that provides a good balancing action with a small leakage and a small risk of mechanical interference at any time during operation of the turbomachine.

SUMMARY OF THE INVENTION

First embodiments of the subject matter disclosed herein relate to a balancing system for a turbomachine.

Second embodiments of the subject matter disclosed herein relate to a method of balancing axial thrust in a turbomachine.

Third embodiments of the subject matter disclosed herein relate to a turbomachine.

BRIEF DESCRIPTION OF THE DRAWINGS

The accompanying drawings, which are incorporated herein and constitute an integral part of the present specification, illustrate exemplary embodiments of the present invention and, together with the detailed description, explain these embodiments. In the drawings:

FIG. 1 shows schematically a first balancing system according to the prior art, FIG. 2 shows schematically a second balancing system according to the prior art.

DETAILED DESCRIPTION

Figure 3:
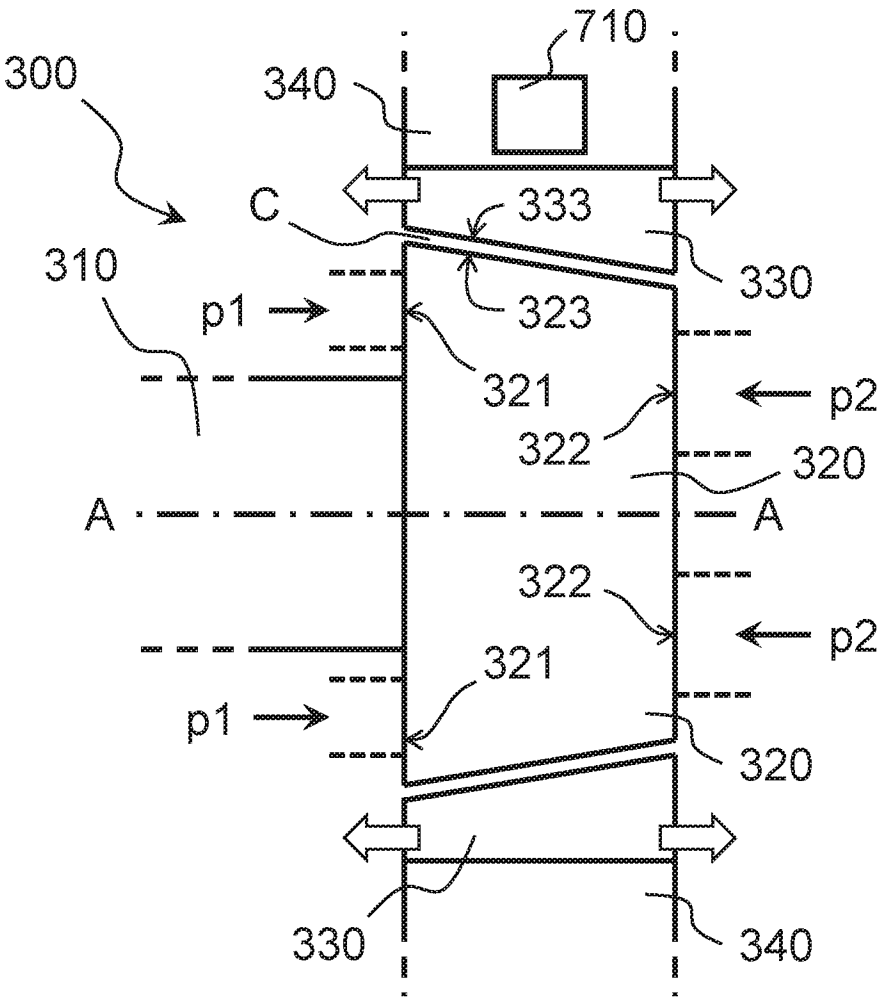
FIG. 3 shows schematically a first embodiment of a balancing system.

The following description of exemplary embodiments refers to the accompanying drawings.

The following description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Furthermore, the particular features, structures or characteristics may be combined in any suitable manner in one or more embodiments.

In a balancing system of the "balance drum" type according to the prior art, the size of the clearance between its cylinder and its sealing ring derives from a compromise between ease of assembly and leakage (during operation) and risk of mechanical interference (during operation). In fact, an easy-assembly requirement leads to choosing a large clearance size, a low-leakage requirement leads to choosing a small clearance size, and a low-risk requirement leads to choosing a large clearance size.

A new type of balancing system for a turbomachine has been conceived wherein a size of a clearance between a balancing body of the balancing system and a sealing ring of the balancing system may be changed during operation of a turbomachine. For example, at the time of assembly clearance may be large as there is no leakage, when the turbomachine is in operation but not rotating clearance may be small as there is no risk of interference, and when the turbomachine is in operation and rotating clearance may be medium so to take into account of leakage and interference; thus, during operation of the turbomachine, clearance is reduced or increased.

In an embodiment, the clearance size is adjusted according to the operating conditions of the turbomachine, such as its rotation speed and/or its operating temperature and/or pressure value of one or more of its operating parameters (for example its suction pressure and/or its discharge pressure). When operating conditions vary (for example its rotation speed and/or its operating temperature and/or its operating pressure changes), the clearance size may be changed.

Thanks to such new type of balancing system, the clearance size may have its best value at any time as it may be varied thus there is no need for the above-mentioned compromise, i.e. for choosing a unique compromise value.

In order to easily change the clearance size, both a balancing body of the balancing system and a sealing ring of the balancing body are, in an embodiment, frustum shape; thus, by changing the axial position of the sealing ring clearance is changed—see for example FIG. 5. Therefore, if, for any reason, the balancing body changes its position and/or its shape and/or its size, it is possible to maintain clearance constant, if so needed or desired, by changing the axial position of the sealing ring.

In the accompanying drawings, the balancing body, that may be called "balanced drum", is conical frustum shape; however, this is only an exemplary shape.

FIG. 3 shows a balancing system 300 mounted to an end of a shaft 310 of a turbomachine such as a compressor, a pump, a turbine or an expander. Shaft 310 is part of a rotor of the turbomachine arranged to rotate about a rotation axis A.

System 300 essentially consists of a balancing body 320 and a sealing ring 330. Balancing body 320 is fixed to an end position of shaft 310. Sealing ring 330 is fixed to an internal wall 340 of a case of the compressor and arranged around balancing body 320 so that balancing body 320 can rotate about rotation axis A, thus there is a clearance C between an external surface 323 of balancing body 320 and an internal surface 333 of sealing ring 330. Both surface 323 and surface 333 are, in an embodiment, frustum shape, more particularly conical frustum shape; in the latter case, the size of the clearance is uniform.

It is to be noted that the above-mentioned shape of the surfaces of body and ring refers to the average 3D contour of body and ring; for example, a body or a ring that has an average 3D contour corresponding to a conical frustum may have a stepped profile (or another profile) and/or may include surface grooves or a labyrinth seal (or another seal).

Additionally, a body or a ring may have a surface being frustum shape and one or more other surfaces with different shapes, for example conical shape.

Finally, it is to be noted that a pyramid shape may be equivalent to a cone shape and a prism shape may be equivalent to a cone shape, depending on the circumstances.

Balancing system 300 comprises an arrangement for changing an axial position of sealing ring 320, that may be called an "adjuster". Such arrangement is schematically shown at 710 in FIG. 3; the arrows pointing to the right indicate the possibility of moving sealing ring 320 farther from balancing body 320, while the arrows pointing to the left indicate the possibility of moving sealing ring 320 closer to balancing body 320.

Clearance C may be adjusted thanks to arrangement/adjuster 710 by changing an axial position of the sealing ring 330. This may be done at any time, in particular during operation of the turbomachine.

Balancing body 320 has a first surface 321 and a second surface 322. Surface 321 may be a portion of a first axial-side surface of balancing body 320, for example the annular surface on the left of body 320. Surface 322 may be a portion of a second axial-side surface of balancing body 320, for example the circular surface on the right of body 320. Balancing system 300 is arranged so that, during operation of the turbomachine, a first fluid at a first pressure p1 exerts a first axial force on surface 321 and pushes balancing body 320 axially in a first sense and a second fluid at a second pressure p2 exerts a second axial force on surface 322 and pushes balancing body 320 axially in a second sense; the second sense is opposite to the first sense; the first fluid and the second fluid may be the same fluid or different fluids. The net axial force deriving from such first axial force and such second axial force is used to counteract an axial force exerted, during operation, by a working fluid of the turbomachine on a rotor of the turbomachine, including shaft 310.

Figure 4:
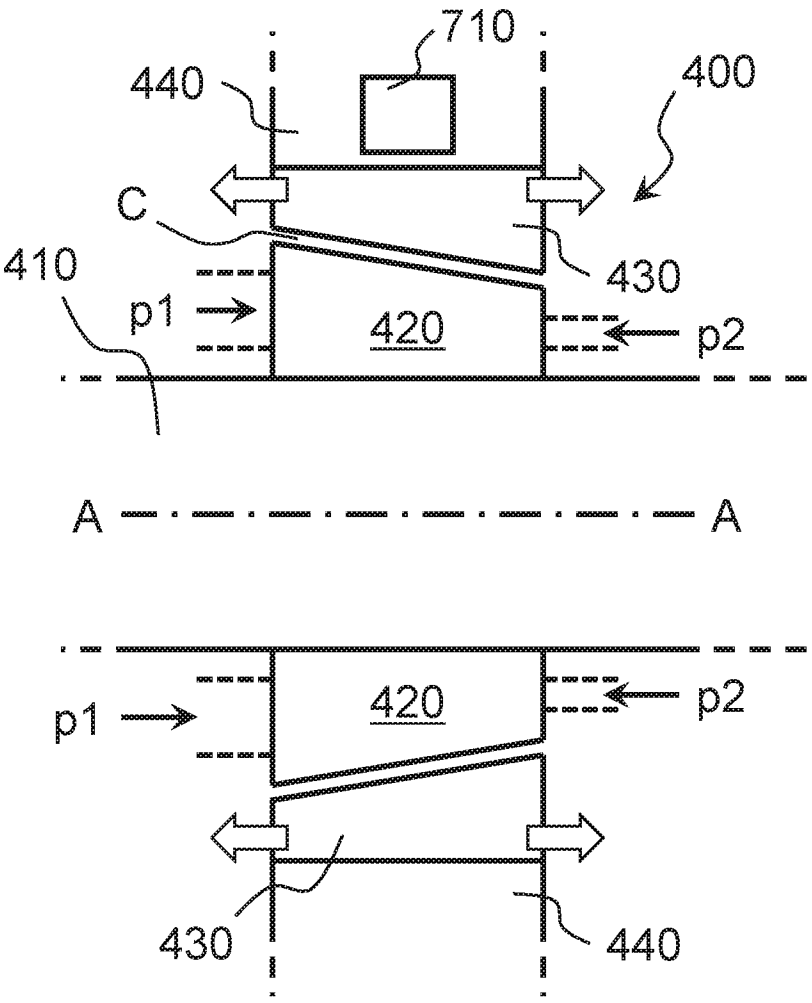
FIG. 4 shows schematically a second embodiment of a balancing system.

FIG. 4 shows another balancing system 400 of a turbomachine very similar to balancing system 300; the main difference is that the balancing body is fixed to a shaft of the turbomachine at an intermediate position of the shaft. FIG. 4 shows a shaft 410 of the turbomachine, such as a compressor, a pump, a turbine or an expander, that is part of a rotor of the turbomachine arranged to rotate about a rotation axis A. FIG. 4 shows partially an internal wall 440 of a case of the turbomachine. Balancing body 400 essentially consists of a balancing body 420 and a sealing ring 430 with a clearance C in-between. Balancing system 400 comprises an arrangement/adjuster 710 for changing an axial position of the sealing ring 430 in particular during operation of the turbomachine. Balancing system 400 is arranged so that, during operation of the turbomachine, a first fluid at a first pressure p1 exerting a first axial force on a first axial side of balancing body 420 and a second fluid at a second pressure p2 exerting a second axial force on a second axial side of balancing body 420 are used to counteract an axial force exerted by a working fluid of the turbomachine on a rotor of the turbomachine, including shaft 410.

It is to be noted that in FIG. 3 and in FIG. 4 the frustum shape of the balancing body points to the right, i.e. towards the end of the shaft. According to a variant of the embodiment of FIG. 3, the frustum shape of the balancing body may point to the left, i.e. towards the center of the shaft. According to a variant of the embodiment of FIG. 4, the frustum shape may point to the left, i.e. towards the center of the shaft. The choice of the orientation of the balancing body in an embodiment of a balancing system may depend, for example, on its rotor-dynamic behavior when mounted in a turbomachine.

Figure 5C:
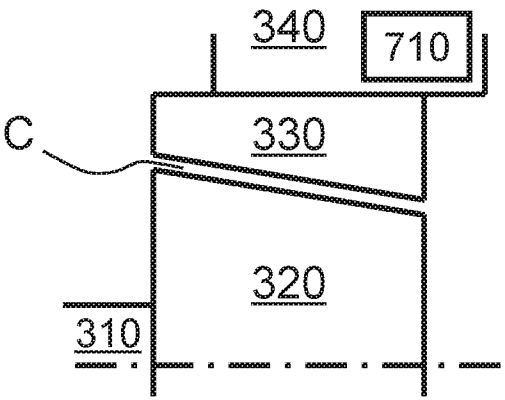
FIG. 5C shows schematically and partially the balancing system of FIG. 3 in a condition wherein a balancing body and a sealing ring are aligned between each other but misaligned with respect to an internal wall.
Figure 5B:
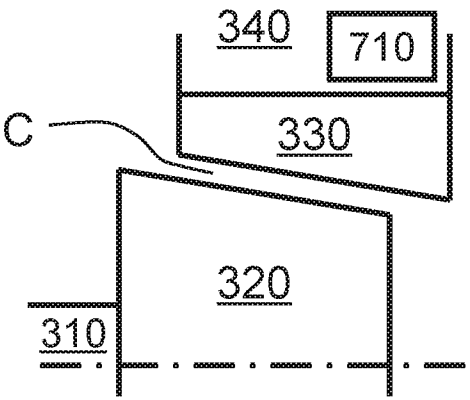
FIG. 5B shows schematically and partially the balancing system of FIG. 3 in a condition wherein a sealing ring is aligned to an internal wall and a balancing body is misaligned with respect to both the sealing ring and the internal wall.
Figure 5A:
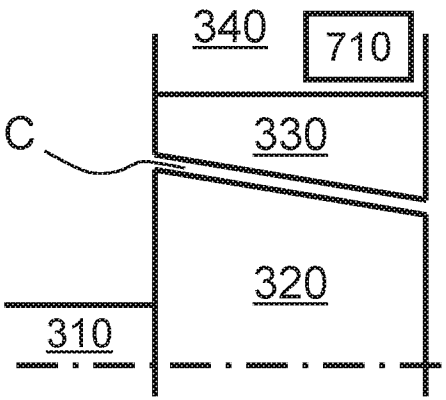
FIG. 5A shows schematically and partially the balancing system of FIG. 3 in a condition wherein a balancing body and a sealing ring are both aligned to an internal wall.

FIG. 5A and FIG. 5B and FIG. 5C shows schematically and partially balancing system of FIG. 3 in three different conditions; the rotor of the turbomachine is rotating, thus shaft 310 and balancing body 320 are rotating while wall 340 and sealing ring 330 are stationary. FIG. 5A corresponds to a condition wherein balancing body 320 and sealing ring 330 are perfectly axially aligned to wall 340; there is a clearance C of a certain size between body 320 and ring 330. After some time, while the rotor of the turbomachine is rotating, the position of balancing body changes its position due to any reason, for example heating of components of the turbomachine. FIG. 5B exemplifies a simple case of axial displacement of balancing body 320 (in the figure, body 320 has moved to the left); due to such displacement, the size of clearance C increases as shown in FIG. 5B. If operation of the turbomachine requires that clearance C has the above-mentioned certain size, i.e. the one shown in FIG. 5A, arrangement/adjuster 710 may causes a change in the axial position of sealing ring 320 and restore the original size of clearance C, as shown in FIG. 5C. In the figure, such position change is a movement to the left.

Figure 6B:
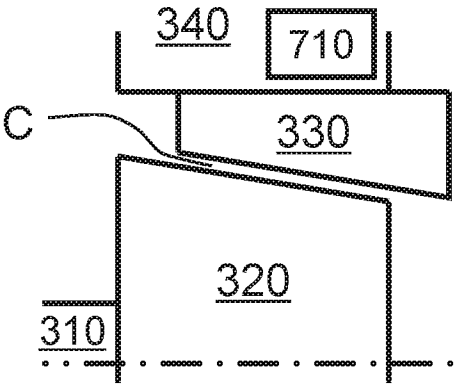
FIG. 6B shows schematically and partially the balancing system of FIG. 3 in a condition wherein a balancing body and an internal wall are aligned between each other but misaligned with respect to a sealing ring.
Figure 6A:
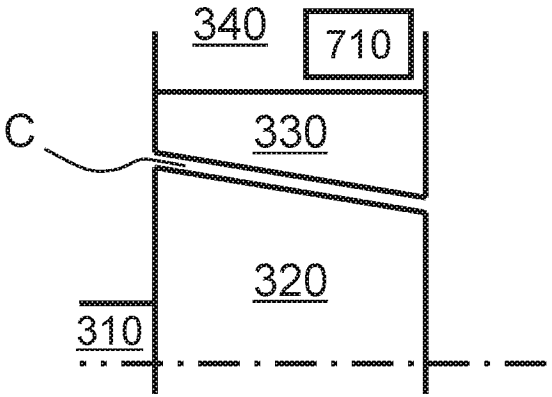
FIG. 6A shows schematically and partially the balancing system of FIG. 3 in a condition wherein balancing body and sealing ring are both aligned to an internal wall.

FIG. 6A and FIG. 6B shows schematically and partially the balancing system of FIG. 3 in two different conditions; the rotor of the turbomachine is rotating, thus shaft 310 and balancing body 320 are rotating while wall 340 and sealing ring 330 are stationary. FIG. 6A corresponds to a condition wherein balancing body 320 and sealing ring 330 are perfectly axially aligned to wall 340; there is a clearance C of a certain size between body 320 and ring 330. After some time, while the rotor of the turbomachine is rotating, some operating conditions of the turbomachine have changed, for example its rotation speed has increased; due to such speed increase, for example, outer size of balancing body has (slightly) increased (due to centrifugal forces). In order to reduce risk of collision between body 320 and ring 330 due to the increased outer size, the original size of clearance C is, in an embodiment, restored, and arrangement/adjuster 710 may causes a corresponding change in the axial position of sealing ring 320, as shown in FIG. 6B. In the figure, such position change is a movement to the right.

Adjustment of the clearance size might be required also for other purposes, for example:

- reducing risk of collision between balancing body and sealing ring due to vibrations of the shaft of the turbomachine (and of the body fixed to the shaft),
- adjusting residual trust on thrust bearings for e.g. stability or loading reasons,
- adjusting rotor-dynamic behavior of the balancing system and its balancing body,
- reducing recirculation flow for performance adjustment (as explained later, fluid flow in clearance C may correspond to a recirculation flow inside the turbomachine)

Figure 7:
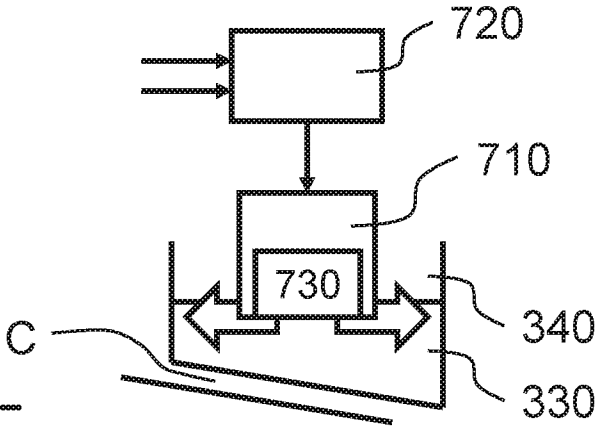
FIG. 7 shows schematically and partially the balancing system of FIG. 3 with some additional components.

FIG. 7 shows schematically and partially the balancing system of FIG. 3 with some additional components, in particular a control unit 720.

Arrangement/adjuster 710 comprises at least one actuator 730 for changing an axial position of sealing ring 330. There may be a first actuator for moving ring 330 in first sense, for example according to the arrow pointing to the left in FIG. 7, and a second actuator for moving ring 330 in second sense, for example according to the arrow pointing to the right in FIG. 7. The or each actuator 730 may be an electric actuator, for example an electric motor, or a magnetic actuator or a hydraulic actuator or a pneumatic actuator. The fluid used by the or each hydraulic actuator or the or each pneumatic actuator may be a fluid used in the turbomachine for other purposes, for example the working fluid or a lubricant fluid, or a fluid specifically dedicated to the movement of the sealing ring.

Sealing ring 330 may slide axially and/or rotate about axis A. For example, sealing ring 330 may have an outer thread arranged to cooperate with an inner thread of e.g. wall 340; by turning sealing ring 330 through an actuator, its axial position may be adjusted.

Control unit 720 is arranged to control arrangement/adjuster 710 so to adjust clearance C. Typically, unit 720 is an electronic control unit and is arranged to receive input electric signals for example from sensors and/or a control panel and to transmit output electric signals to arrangement 710, for example to the or each actuator 730.

Control unit 720 may perform an open-loop control or a closed-loop control.

It is to be noted that all figures show the balancing body and the sealing ring as a solid single-piece part; however, this is only because these figures are simplified. In general, the balancing body and/or the sealing ring may consist of several parts assembled together. In general, the balancing body and/or the sealing ring may have one or more internal voids, for example conduits such as so-called "shunt holes".

Figure 8:
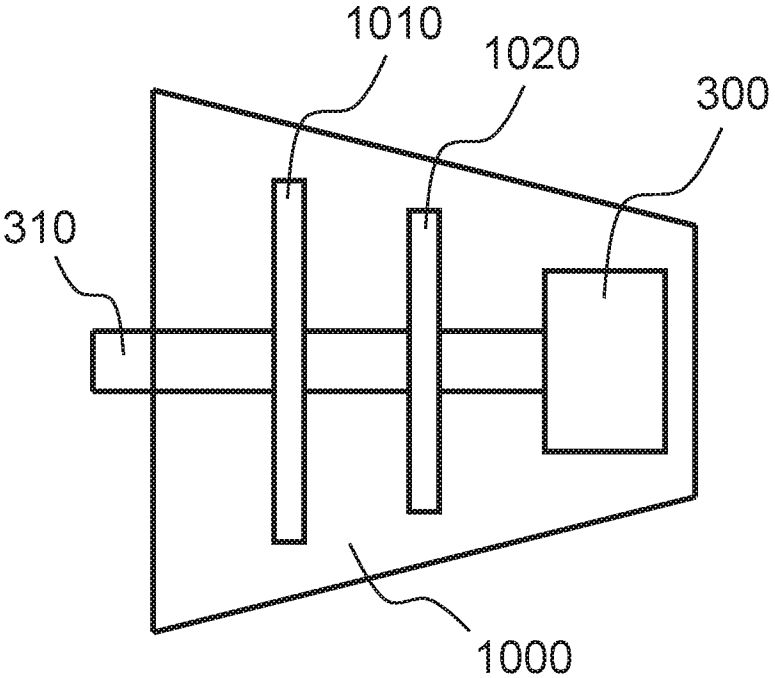
FIG. 8 shows very schematically an embodiment of a turbomachine.

FIG. 8 shows very schematically an embodiment of a turbomachine 1000 comprising the balancing system 300 of FIG. 3. Turbomachine 1000 is a compressor; alternative embodiments of the turbomachine may be a pump, a turbine or an expander.

Compressor 1000 has two compression stages both associated to a shaft 310. Balancing system 300 is fixed to an end position of shaft 310. FIG. 8 shows a first assembly 1010 of a first compressor stage and a second assembly 1020 of a second compressor stage. Assemblies 1010 and 1020 and shaft 310 form a rotor of compressor 1000.

When the rotor of compressor 1000 rotates, a working fluid flowing through the compressor acts on the assemblies 1010 and 1020 and an axial force is exerted on shaft 310. Balancing system 300 is arranged to counteract such axial force.

An embodiment of a balancing method for a turbomachine will be described in the following with the aid of FIG. 3 and FIG. 9. The method is aimed at reducing axial thrust borne by thrust bearings of a turbomachine, such as the compressor shown in FIG. 8, through a balancing system, such as the one shown in FIG. 3.

First of all, the turbomachine, for example a compressor, is assembled together with its balancing system 300. At a step 901, sealing ring 330 is set to an initial position.

At a step 902, the compressor is started, i.e. its rotor is put in rotary motion.

At a step 903, a fluid is pressurized at a first pressure p1 on a first side of balancing body 320. Such fluid may be for example the working fluid of the compressor and pressure p1 may be the discharge pressure of the compressor. Alternatively, pressure p1 may be a different pressure of the turbomachine, for example the discharge pressure of the compressor.

At a step 904, a fluid is pressurized at a second pressure p2 on a second side of balancing body 320. Such fluid may be for example the working fluid of the compressor and pressure p2 may be the suction pressure of the compressor. Alternatively, pressure p2 may be a different pressure of the turbomachine, for example the suction pressure of the compressor.

If, for example, pressure p1 is the discharge pressure of the compressor and pressure p2 is the suction pressure of the compressor, fluid flow in the clearance of the balancing system corresponds to a recirculation flow inside the compressor.

It is to be noted that even if step 904 is described after step 903, typically they may occur at any time, for example at the same time or almost at the same time, and in any order.

The reason for applying pressures of the axial side surfaces of the balancing body is to create a net pressure axial force able to counteract a shaft axial force. A pressure force corresponds to a product between pressure and surface area. Considering FIG. 3, a first force corresponds to the product between pressure p1 and the area of surface 321 and a second force corresponds to the product between pressure p2 and the area of surface 322; this means that pressures p1 and p2 may be different or equal and the areas of surface 321 and 322 may be different or equal.

Afterwards, during operation of the turbomachine, at a step 907, an axial position of sealing ring 330 is changed, if desired or necessary, thereby adjusting clearance C.

Figure 9:
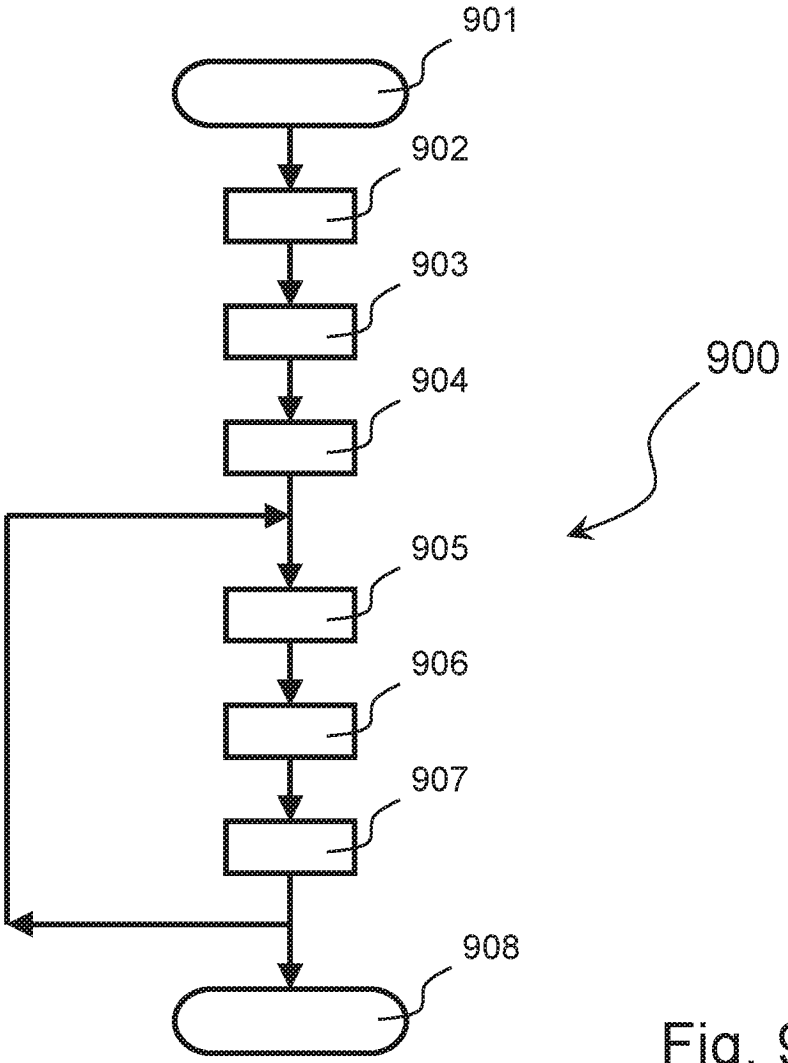
FIG. 9 shows a flow chart of an embodiment of a balancing method.

Step 907 may be repeated, in an embodiment, periodically repeated, during operation of the turbomachine; this is shown in FIG. 9 by a loop in the flowchart.

At step 907, the axial position change may be obtained by suitably driving an actuator that may be an electric actuator, for example an electric motor, or a magnetic actuator or a hydraulic actuator or a pneumatic actuator. The fluid used by the or each hydraulic actuator or the or each pneumatic actuator may be a fluid used the turbomachine for other purposes, for example the working fluid or a lubricant fluid, or a fluid specifically dedicated to the movement of the sealing ring.

The axial position change may be carried out under manual control or automatic control, in particular open-loop control or closed-loop control.

The embodiment of FIG. 9 implements an automatic control, and the method comprises a step 905 of measuring one or more parameters of the compressor and a step 906 of calculating an axial position based on the one or more parameters just measured; the position calculated at step 906 is then used at step 907.

Therefore, the above-mentioned loop provides that steps 905, 906 and 907 be carried out sequentially.

Finally, at a step 908, axial position of sealing ring 330 is reset to an initial position just before shutting down or tripping the turbomachine.

The parameters measured at step 905 may be one or more of the following parameters:

inlet pressure of the turbomachine,
outlet pressure of the turbomachine,
inlet temperature of the turbomachine,
outlet temperature of the turbomachine,
rotation speed of the turbomachine,
temperature of a zone of the turbomachine,
temperature of a zone of sealing ring 330,
temperature of a zone of balancing body 320,
fluid flow in clearance C,
size of clearance C,
(residual) axial thrust on a bearing of the turbomachine.

Some of the above parameters provide direct indications on the operation of the bearing system; these parameters are residual axial thrust on a thrust bearing of the turbomachine, fluid flow in the clearance and size of the clearance. The axial thrust may be measured for example by a load cell associated to the thrust bearing. The clearance fluid flow may be measured for example by a flow meter associated to the line or lines feeding pressurized fluid or fluids to the sides of the bearing system. The clearance size may be measured for example through a distance meter associated to the sealing ring; alternatively, a proximity sensor associated to the sealing ring may be used if an embodiment of the control method requires only a safety check, for example that the clearance size does not go below or beyond a certain limit.

Alternatively, residual axial thrust on a thrust bearing of the turbomachine, fluid flow in the clearance and size of the clearance may be estimated through formulas based on operating parameters of the turbomachine, such as a subset of the following parameters: inlet pressure of the turbomachine, outlet pressure of the turbomachine, inlet temperature of the turbomachine, outlet temperature of the turbomachine, rotation speed of the turbomachine, temperature of a zone of the turbomachine, temperature of a zone of the sealing ring, temperature of a zone of the balancing body.

Several control strategies may be implemented; three strategies will be briefly described in the following; other strategies are possible.

According to a first control strategy, the position of the sealing ring is controlled so that clearance size maintains a certain value or within a certain range of values.

According to a second control strategy, the position of the sealing ring is controlled so that clearance fluid flow maintains a certain value or within a certain range of values.

According to a third control strategy, the position of the sealing ring is controlled so that residual thrust maintains a certain value or within a certain range of values.

The above-mentions values and range of values may be varied in accordance with the operating conditions of the turbomachines, for example as a function of one or more operating parameters of the turbomachine.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A balancing system for a turbomachine comprising a rotor, a stator and a casing defining an internal wall having a threaded portion, the balancing system comprising:

a balancing body to be mounted on the rotor;

a sealing ring to be mounted on the stator, wherein the sealing ring is arranged around at least a portion of the balancing body so the balancing body can rotate about a rotation axis extending longitudinally through the balancing body; and an actuator configured to change an axial position of the sealing ring during operation of the turbomachine so that a clearance between the balancing body and the sealing ring can be adjusted during the operation of the turbomachine, wherein the sealing ring defines an outer thread that cooperates with the threaded portion of the internal wall of the casing, and the actuator is configured to change the axial position of the sealing ring by turning the sealing ring about the rotation axis to translate the sealing ring axially along the threaded portion.

2. The balancing system of claim 1, wherein an inner surface of the sealing ring is frustum shape.

3. The balancing system of claim 1, wherein an outer surface of the portion of the balancing body is frustum shape.

4. The balancing system of claim 1, further comprising a control unit configured to control the actuator.

5. The balancing system of claim 4, wherein the control unit is arranged to perform an open-loop control or a closed-loop control.

6. The balancing system of claim 1, wherein the balancing body has a first surface and a second surface, wherein the balancing body is arranged so that a fluid at a first pressure exerts a force on the first surface and pushes the balancing body axially in a first sense and a fluid at a second pressure exerts a force on the second surface and pushes the balancing body axially in a second sense, the second sense being opposite to the first sense.

7. A turbomachine comprising a balancing system according to claim 1, wherein the balancing body is fixed to a shaft of the turbomachine.

8. A method of balancing axial thrust in a turbomachine comprising a rotor, a stator a casing defining an internal wall having a threaded portion, a balancing body and a sealing ring defining an outer thread that cooperates with the threaded portion of the internal wall of the casing, wherein the balancing body is fixed to a shaft of the rotor of the turbomachine, and the sealing ring is fixed to the stator of the turbomachine and arranged around at least a portion of the balancing body so that the balancing body can rotate about a rotation axis, the method comprising:

starting the turbomachine;

pressurizing a fluid at a first pressure on a first side of the balancing body;

pressurizing a fluid at a second pressure on a second side of the balancing body, and afterwards during operation of the turbomachine;

changing an axial position of the sealing ring by rotating the sealing ring about the rotation axis such that the sealing ring axially translates along the threaded portion; and adjusting a clearance between the balancing body and the sealing ring via the axial translation of the sealing ring.

9. The method of claim 8, wherein changing the axial position of the sealing ring is repeated during operation of the turbomachine.

10. The method of claim 8, wherein the axial position of the sealing ring is reset to an initial position just before shutting down or tripping the turbomachine.

* * * * *